US012110152B2

(12) United States Patent
Lang

(10) Patent No.: US 12,110,152 B2
(45) Date of Patent: Oct. 8, 2024

(54) DUAL-CHAMBER BEVERAGE CONTAINER

(71) Applicant: Tam H. Lang, Chandler, AZ (US)

(72) Inventor: Tam H. Lang, Chandler, AZ (US)

( * ) Notice: Subject to any disclaimer, the term of this patent is extended or adjusted under 35 U.S.C. 154(b) by 230 days.

(21) Appl. No.: 17/940,148

(22) Filed: Sep. 8, 2022

(65) Prior Publication Data

US 2023/0096471 A1 Mar. 30, 2023

Related U.S. Application Data

(60) Provisional application No. 63/248,402, filed on Sep. 24, 2021.

(51) Int. Cl.

| | |
|---|---|
| ***B65D 25/04*** | (2006.01) |
| ***A47G 19/22*** | (2006.01) |
| ***B65D 81/18*** | (2006.01) |
| ***B65D 81/38*** | (2006.01) |

(52) U.S. Cl.

CPC ..... *B65D 25/04* (2013.01); *A47G 19/2288* (2013.01); *B65D 81/18* (2013.01); *B65D 81/3841* (2013.01)

(58) Field of Classification Search

CPC .... B65D 25/04; B65D 81/18; B65D 81/3841; A47G 19/2288

USPC ..... 222/146.1, 146.6

See application file for complete search history.

(56) References Cited

U.S. PATENT DOCUMENTS

| | | | | |
|---|---|---|---|---|
| 5,823,380 | A * | 10/1998 | Cox | A47J 36/2461 222/456 |
| 5,961,004 | A | 10/1999 | DeMars | |
| 6,471,085 | B1 | 10/2002 | Gallo | |
| 9,321,064 | B2 | 4/2016 | Vanier | |
| 2014/0048510 | A1* | 2/2014 | Kilduff | F28D 15/00 165/104.19 |
| 2015/0122688 | A1* | 5/2015 | Dias | A47G 19/027 206/459.1 |
| 2018/0333007 | A1* | 11/2018 | Ganahl | A47J 31/005 |

* cited by examiner

*Primary Examiner* — Vishal Pancholi

(74) *Attorney, Agent, or Firm* — Argus Intellectual Enterprise, LLC; Jordan Sworen; Daniel Enea

(57) ABSTRACT

A dual-chamber beverage container for reducing a temperature of a hot beverage to a safe and comfortable drinking temperature. The dual-chamber beverage container includes an insulated bottom chamber for maintaining a temperature of a hot liquid, a cooling chamber for receiving and cooling the hot liquid to a comfortable drinking temperature, and a housing. The housing contains a motorized pump operably connected to a power source also contained within the housing. A transport tube extends from the bottom chamber, through a channel within the housing and terminates within the cooling chamber. A switch is disposed on an exterior side of the beverage container and operably connected to the motorized pump such that activation of the switch causes the motorized pump to pump air into the bottom chamber, displacing the liquid and forcing the liquid from the bottom chamber into the cooling chamber through the transport tube.

20 Claims, 7 Drawing Sheets

DUAL-CHAMBER BEVERAGE CONTAINER

CROSS REFERENCE TO RELATED APPLICATION

This application claims the benefit of U.S. provisional application No. 63/248,402 filed on Sep. 24, 2021; the above identified patent application is herein incorporated by reference in its entirety.

BACKGROUND OF THE INVENTION

The present invention relates to beverage containers. More specifically, the present invention relates to a personal beverage container for regulating a temperature of a liquid to a desired drinking temperature.

Insulated beverage containers can maintain a temperature of a liquid for many hours. The prolonged temperature maintenance does not typically present an issue of safe drinking temperature for beverages that are stored at a cold temperature because when the beverage is ready to be consumed, the temperature of the liquid will remain cold. However, if a beverage, such as coffee, is initially added to an insulated container when it is hot, the stored temperature of the liquid will remain hot and exceed a comfortable drinking or sipping temperature for most consumers. In extreme cases, the stored temperature of the beverage might even scald a user who drinks it without waiting for it to cool. The hotter a beverage is stored, the better insulated the storage container, the longer it will maintain its heat; retaining heat for a long time is desirable for hot drinks. At the same time, it is also desirable to reduce the heat of the stored beverage to a comfortable and safe temperature before drinking.

One solution to cooling down an overly hot beverage is to pour it into a secondary container to let it cool. However, many people on the go drink from travel containers and do not have the ability to pour while traveling or carry a secondary container. Some devices exist that are intended to modify the temperature of the entirety of the container's contents, as opposed to modifying incremental amounts of the temperature of the beverage at various desired times. Some temperature-controlled drink containers enable a user to set a specific temperature for the beverage contents to be maintained. Further, these devices are expensive and, unless continuously connected to a power source, none keeps a beverage as hot for as long as a common vacuum insulated container.

The experience of drinking a cup of a hot beverage is commonly characterized by taking a first sip that is too hot, followed by sips that are comfortably warm and then by final sips that are too cold. There is an arc to the experience that many people find enjoyable, made more so by the chance to get a fresh cup, and start the experience all over again. By design, temperature maintaining beverage containers do not provide this experience.

There is accordingly a need for a beverage container that keeps beverages hot for long periods of time, enables a user to quickly cool down a portion of beverage for comfortable drinking or sipping and also offers the option of repeatedly enjoying the arc of experience of drinking a portion of beverage as it cools over time and then repeating the experience without refilling the entire beverage container.

In light of the devices disclosed in the known art, it is submitted that the present invention substantially diverges in design elements and methods from the known art and consequently it is clear that there is a need in the art for an improvement for a dual-chamber beverage container. In this regard the instant invention substantially fulfills these needs.

SUMMARY OF THE INVENTION

In view of the foregoing disadvantages inherent in the known types of beverage containers now present in the known art, the present invention provides a dual-chamber beverage container for maintaining the temperature of a stored beverage within a first chamber and cooling a portion of the stored beverage within a second chamber via a pump mechanism.

It is an objective of the present invention to provide an embodiment of a dual-chamber beverage container comprising an insulated bottom chamber for maintaining the temperature of the stored beverage and a cooling chamber into which beverage from the bottom chamber is transferred through the pump mechanism. The cooling chamber is configured to readily cool the beverage for comfortable and safe drinking of the hot beverage transferred from the bottom chamber.

It is another objective of the present invention to provide an embodiment of the dual-chamber beverage container comprising a lid, a cooling chamber, an insulated bottom chamber, a pump chamber, a pump, an air feed into the bottom chamber and a transport tube for moving portions of beverage from bottom chamber into the cooling chamber.

It is another objective of the present invention to provide an embodiment of the dual-chamber beverage container that rapidly reduces the temperature of hot beverages stored in the insulated bottom chamber to a cooler temperature that is safe and comfortable for consumption.

It is therefore an object of the present invention to provide a new and improved dual-chamber beverage container that has all of the advantages of the known art and none of the disadvantages.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purposes of presenting a brief and clear description of the present invention, the preferred embodiment will be discussed as used for regulating a temperature of a liquid to a desired drinking temperature. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment", "first embodiment", "second embodiment", or "third embodiment" does not necessarily refer to the same embodiment.

Figure 1:
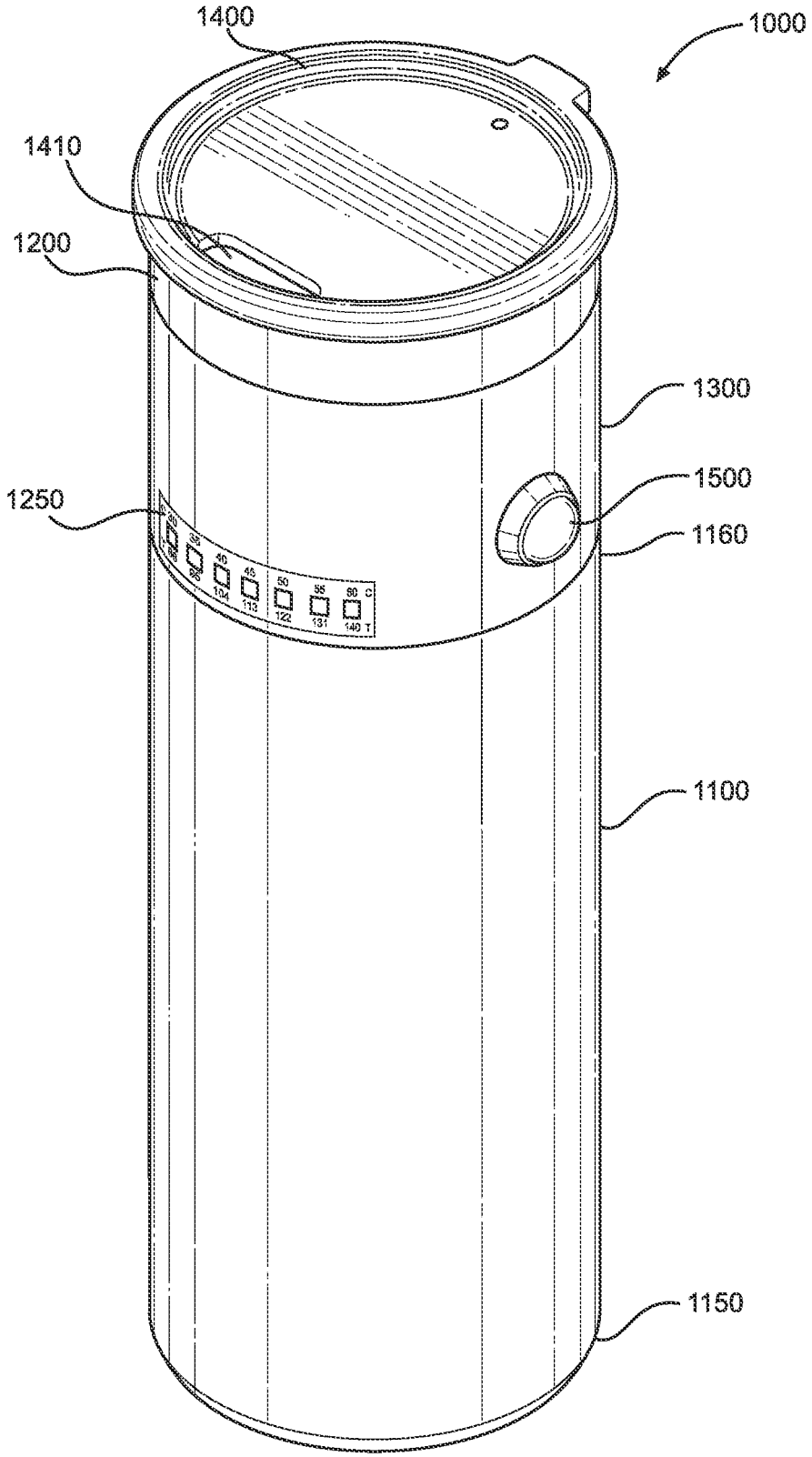
FIG. 1 shows a perspective view of an embodiment of the dual-chamber beverage container.
Figure 2:
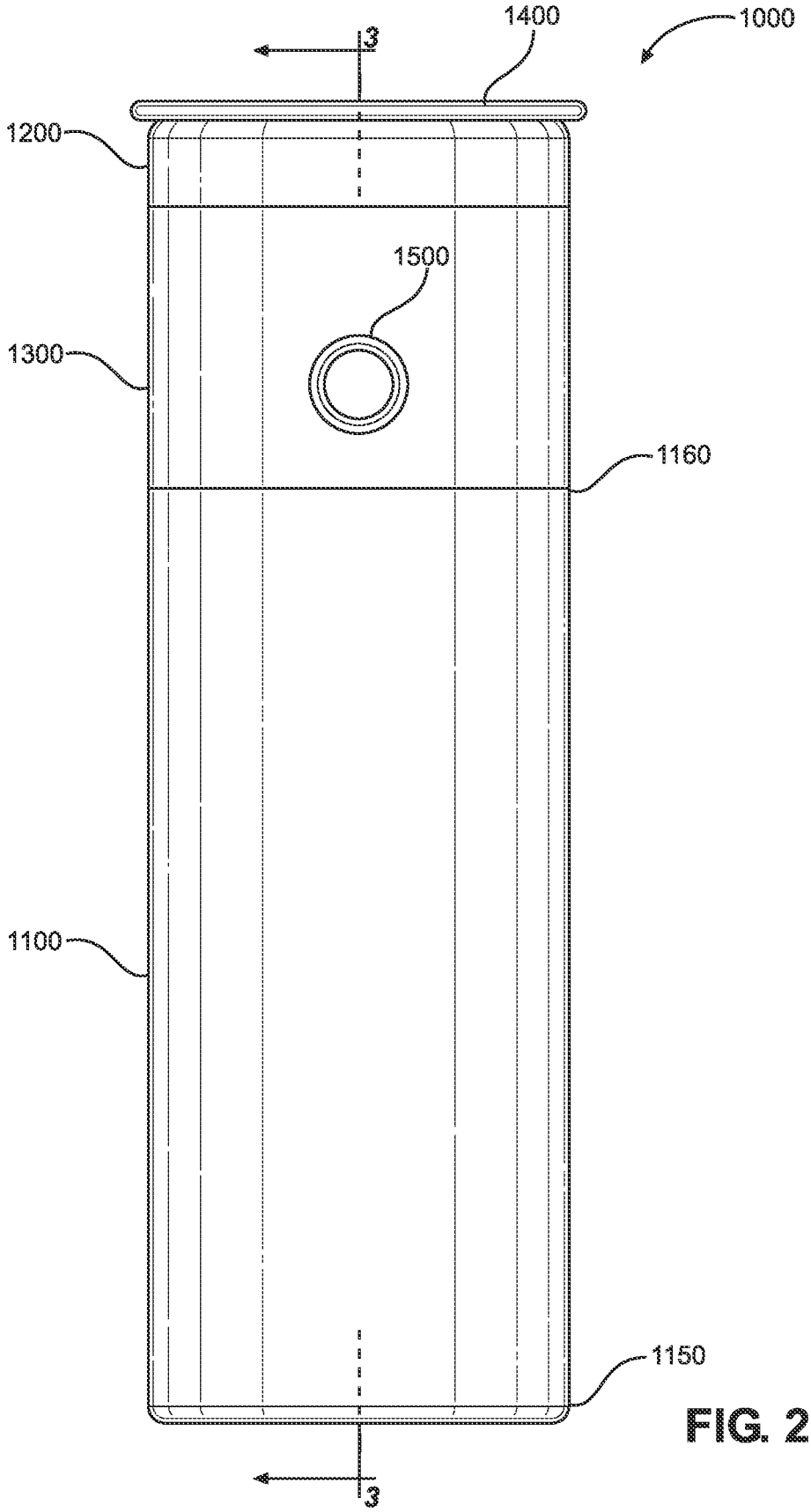
FIG. 2 shows a side view of an embodiment of the dual-chamber beverage container.
Figure 3:
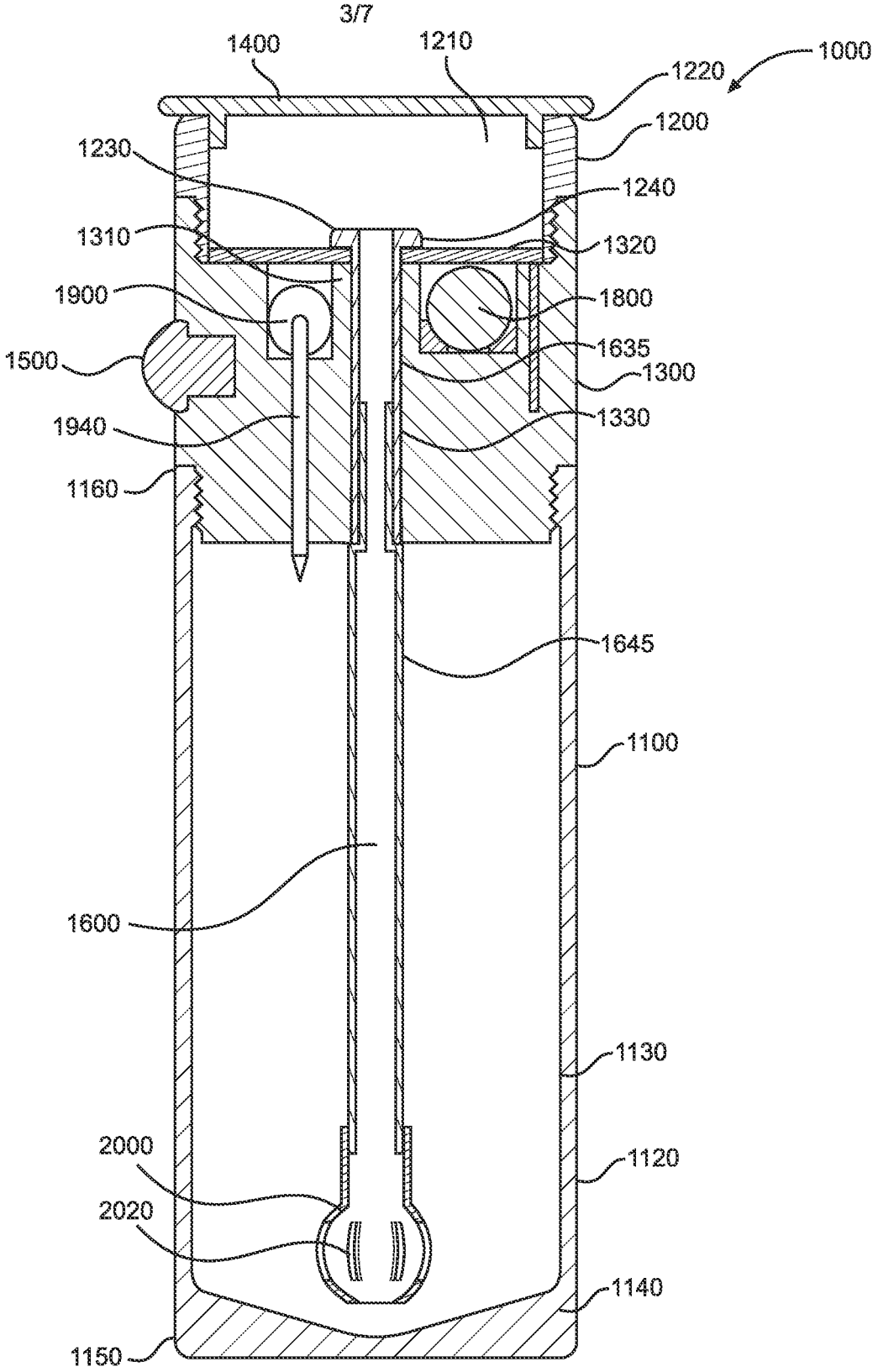
FIG. 3 shows a cross-sectional view of an embodiment of the dual-chamber beverage container along lines 3-3 of FIG. 2.

Referring now to FIGS. 1-3, there is shown a perspective view, a side view, and a cross-sectional view of an embodiment of the dual-chamber beverage container, respectively. The dual-chamber beverage container 1000 comprises a first chamber, a second chamber, and a housing 1300 disposed therebetween. The first chamber is configured to receive a hot liquid and maintain the temperature of the hot liquid for a prolonged period of time. The second chamber is configured to receive a predetermined amount of liquid from the first chamber and rapidly cool the liquid to a comfortable drinking temperature. The housing 1300 stores a power source and a pump that is operably connected to a switch 1500 that upon activation of the switch 1500, the liquid is transferred between the chambers through a transport tube 1600.

In the illustrated embodiment, the first chamber is a bottom chamber 1100 and the second chamber is a cooling chamber 1200, wherein the cooling chamber 1200 and the housing 1300 are disposed above the bottom chamber 1100, such that the bottom chamber 1100, cooling chamber 1200, and housing 1300 are vertically aligned and comprise a circular cross section forming a cylindrical exterior. However, in alternate embodiments, other configurations of the first chamber and the second chamber are contemplated, such as an offset or side-by-side configuration. The bottom chamber 1100 comprises an interior volume 1110 configured to retain the liquid therein. The bottom chamber 1100 is insulated, having an exterior wall 1120 and an interior wall 1130 forming a vacuum space 1140 therebetween. In the illustrated embodiment, the vacuum space 1140 extends from a lower end 1150 to an upper end 1160 of the bottom chamber 1100. In this way, the bottom chamber 1100 is configured to maintain the temperature of the liquid placed therein with minimal temperature loss. In other embodiments, the bottom chamber 1100 uses a heating source for maintaining heat and controlling the temperature therein, such as a heating element embedded between the walls of the first chamber and operably connected to a power source within the housing 1300. Alternate embodiments contemplate different heating sources configured to control temperature within the bottom chamber.

The cooling chamber 1200 comprises a reservoir 1210 that receives and retains the predetermined amount of liquid therein. An aperture 1230 is disposed on the bottom of the reservoir 1210 to allow the liquid to be received from the bottom chamber 1100 via the transport tube 1600. In the illustrated embodiment, the upper end 1220 of the cooling chamber 1200 is open to allow the predetermined amount of liquid to flow therefrom. In the illustrated embodiment, the open upper end 1220 is removably covered by a lid 1400. In some embodiments, the lid 1400 comprises a solid surface with no openings to prevent liquid from leaving the cooling chamber 1200 when the lid 1400 is secured thereto. In other embodiments, the lid 1400 comprises an opening 1410 to allow a user to sip the predetermined amount of liquid from the cooling chamber 1200 when the lid 1400 is secured thereto.

In the illustrated embodiment, the cooling chamber 1200 and lid 1400 are composed of a clear or transparent material so that the user can view the liquid being pumped into the cooling chamber 1200. This visualization of the flowing liquid allows the user to know how much liquid has been dispensed and is available for drinking. In some embodiments, a sidewall of the cooling chamber is composed of a transparent material, whereas in other embodiments, the sidewall comprises a window to allow the user to view the interior of the cooling chamber. The transparent and uninsulated material allows the liquid to cool more quickly as a result of heat from the hot liquid to travel more freely through transparent media. In alternate embodiments, the cooling chamber comprises a cooling member, such as a cooling plate or radiator, to facilitate faster cooling of the hot liquid dispensed into the cooling chamber 1200.

In some embodiments, a temperature indicator 1250 is operably connected to the cooling chamber 1200 and displayed on an exterior of the dual-chamber beverage container 1000. The temperature indicator 1250 is configured to detect and display an indication of the temperature of the liquid within the cooling chamber 1200. In some embodiments, the indication displayed of the temperature is the degree Fahrenheit and/or Celsius of the liquid, such as temperatures between 40 and 75 Celsius (104-167 degrees Fahrenheit) as well as an indicator that the temperature is above or below the range. In other embodiments, different indicators of comfortable drinking temperature are contemplated, such as a color change to the temperature indicator 1250.

In the illustrated embodiment, the transport tube 1600 extends centrally through a vertical axis of the chambers 1100, 1200 and housing 1300, wherein the vertical axis is disposed between the lower and cooling chamber 1100, 1200. In alternate embodiments, the transport tube 1600 is offset from the center of the housing 1300. In the illustrated embodiment, the transport tube 1600 extends from a lowermost end of the interior volume of the bottom chamber through the open upper end where the transport tube 1600 is removably secured within the housing 1300.

In the illustrated embodiment, the transport tube 1600 comprises a first section 1635 and a second section 1645. The first section 1635 is integrated within the cooling chamber and forms a channel extending from the aperture 1230 thereof. The first section 1635 extends through the housing 1300 and terminates at a lower end of the housing. The second section 1645 comprises a smaller upper end forming a shoulder, wherein the smaller upper end that fits within the lower end of the first section 1635 of the transport tube 1600. The upper end of the second section 1645 comprises a smaller diameter than a diameter of the lower end of the second section 1645 of the transport tube 1600. The shoulder prevents the second section 1645 from inserting further into the first section 1635. The second section 1645 of the transport tube 1600 is frictionally fit within the first section 1635 of the transport tube. In the illustrated embodiment, the friction fit allows the transport tube 1600 to be selectively removed and replaced for cleaning purposes. In alternate embodiments, the transport tube comprises a single, monolithic structure, wherein a fastener is used to secure the transport tube in place. In some embodiments, the transport tube 1600 is permanently secured within the housing 1300 by the fastener. In some embodiments, a portion of the transport tube extends into the reservoir of the cooling chamber 1200 allowing liquid to be effectively transferred therein. In the illustrated embodiment, the transport tube 1600 terminates at the aperture 1230 of the cooling chamber 1200.

In the illustrated embodiment, a filter 2000 is removably secured to the lowermost end of the transport tube 1600. The filter 2000 comprises a first end having a channel that receives the transport tube 1600 therein and a bulbous second end. The bulbous second end comprises a plurality of slotted openings 2020 disposed at fixed intervals therearound. The slotted openings 2020 are disposed along a vertical axis and are sized to filter out particles from a hot beverage such as tea leaves and/or coffee grounds. In other embodiments, the filter comprises any suitable configuration, such as a mesh screen covering the lowermost end of the transport tube. In some embodiments, the dual-chamber beverage container does not comprise a filter.

In some embodiments, the transport tube 1600 comprises a dispersal cap disposed on an upper end thereof that allows for the dispersal of the liquid when exiting the transport tube 1600 such that the flow of liquid is broken into a multitude of small streams or droplets as it is dispensed into the cooling chamber 1200. In this way, the dispersal cap exposes more surface area of the hot liquid flowing from the bottom chamber 1100 to air as it exits into the cooling chamber 1200 and thereby cooling it more quickly. In some embodiments, the dispersal cap is a screen having a plurality of apertures. In some embodiments, the apertures are angled outwards to disperse the liquid in a plurality of different directions.

Figure 4:
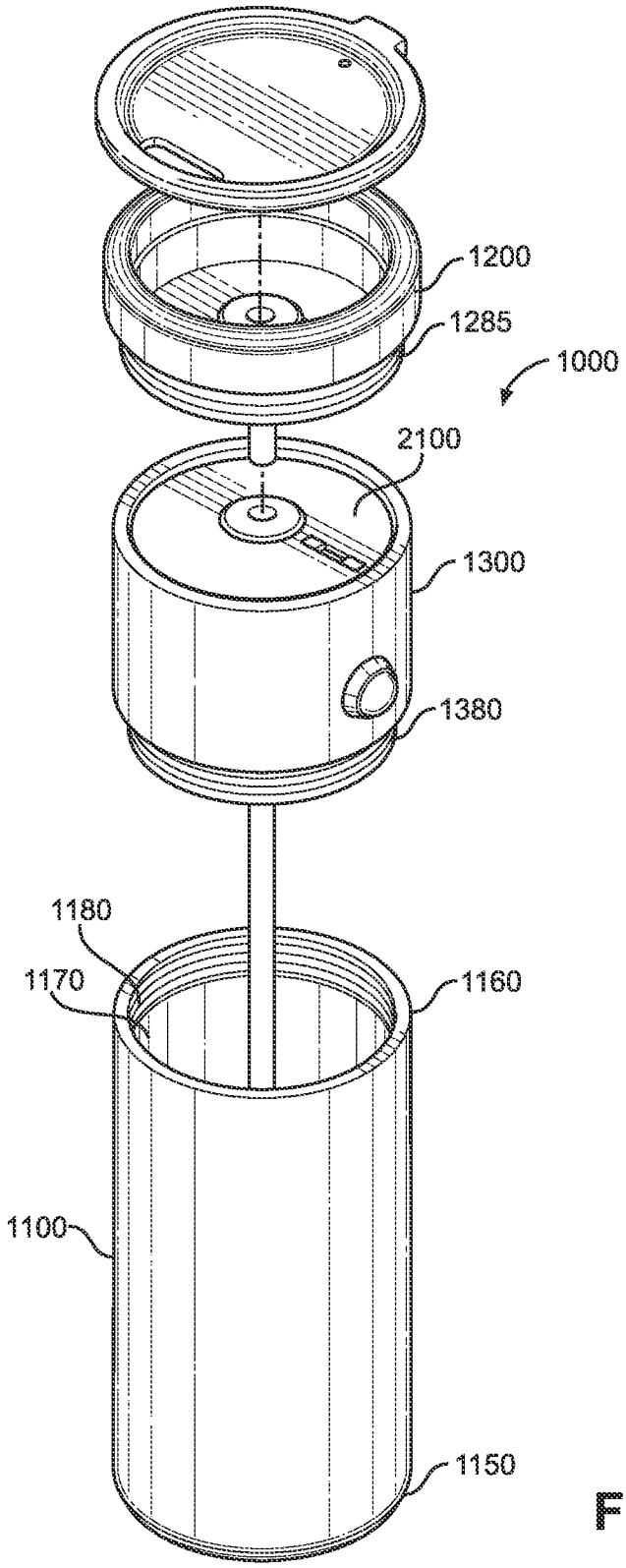
FIG. 4 shows an exploded view of an embodiment of the dual-chamber beverage container.

Referring now to FIGS. 3 and 4, there is shown the cross-sectional view of an embodiment of the dual-chamber beverage container along lines 3-3 of FIG. 2 and an exploded view of another embodiment of the dual-chamber beverage container, respectively. The upper end 1160 of the bottom chamber 1100 comprises an opening 1170 configured to receive the liquid therein. The opening 1170 of the bottom chamber 1100 comprises a perimeter distance similar to a perimeter distance of the interior wall 1130 thereof. The upper end 1160 of the interior wall 1130 comprises a fastener in which the housing 1300 can be removably connected thereto. In the illustrated embodiment, the fastener is threading 1180 disposed on the interior of the interior wall mated with threading 1380 disposed on an exterior wall of a lower end of the housing 1300. In the illustrated embodiment, a lower end of the cooling chamber 1200 is removably secured to an upper end of the housing 1300 via mated threading 1385, 1285. In the illustrated embodiment, a first and second gasket are disposed on an upper rim and a lower rim, respectively, of the housing 1300 to provide a seal between the upper and bottom chambers 1100, 1200 when attached thereto.

In the illustrated embodiment, the aperture 1230 of the cooling chamber 1200 is disposed through a first protrusion 1240 comprising a threaded underside configured to threadedly engage a second protrusion 1310 extending from an upper side 1320 of the housing 1300. This threaded engagement allows additional securement of the cooling chamber 1200 to the housing 1300. In the illustrated embodiment, a third gasket is disposed on an upper rim of the second protrusion 1310 to provide an air-tight seal between the housing 1300 and the cooling chamber 1200. In alternate embodiments, the first protrusion and the second protrusion are secured to one another via any suitable fastener. The first protrusion 1240 and the second protrusion 1310 align the aperture 1230 with a channel 1330 of the housing 1300. The channel 1330 extends through the entire housing 1300, along a vertical axis, wherein the channel 1330 receives the transport tube 1600 therethrough.

Figure 5:
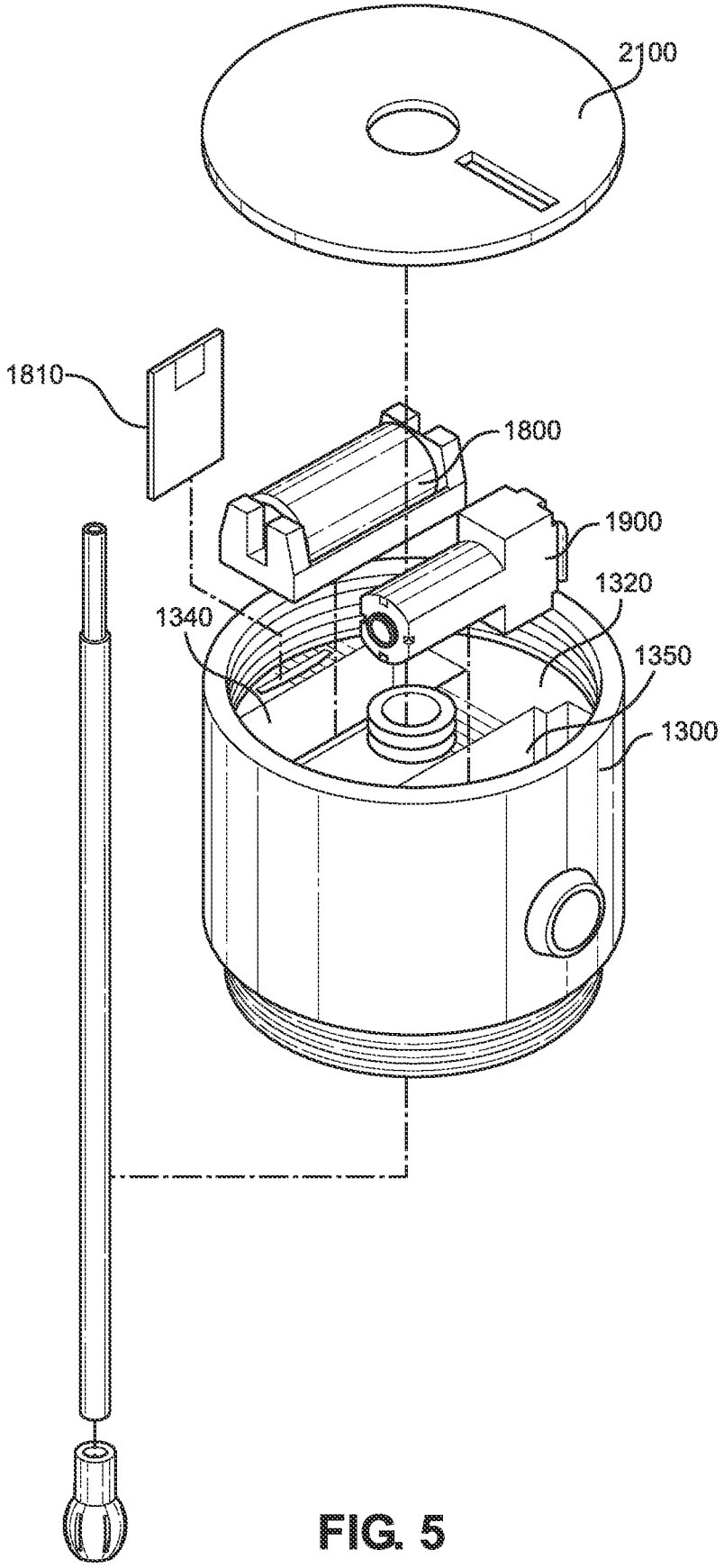
FIG. 5 shows an exploded view of the housing of the dual-chamber beverage container.

The housing 1300 comprises an interior volume that protects and houses the power source 1800 and the pump 1900. When the cooling chamber 1200 is secured to the housing 1300, the interior volume of the housing 1300 is sealed and liquid from either the cooling chamber 1200 or bottom chamber 1100 are prevented from entering the housing 1300. The liquid can only pass between the upper and bottom chambers and through the housing 1300 via the transport tube 1600. In some embodiments, as shown in FIGS. 4 and 5, the housing 1300 comprises a housing cover 2100 that conceals the pump and the battery. The housing cover 2100 is a disc-like structure having an aperture that sits around the second protrusion 1310 of the housing 1300. In other embodiments, as shown in FIG. 3, the housing 1300 does not comprises a housing cover.

The power source 1800 is configured to supply power to the pump 1900. In some embodiments, the power source 1800 is a battery configured to be replaced by the user as needed. In alternate embodiments, the power source is rechargeable wherein the housing comprises a port configured to connect with an external power source for recharging. Because the power source 1800 is used only intermittently for pumping, it will require charging or replacement infrequently. Thus, in some embodiments having a port and a rechargeable power source, the power source may also serve as a power bank for charging cell phones and other portable devices. In some embodiments, the power source is a lithium battery and comprises a power charger board 1810 configured to regulate the electrical power to match a desired input of the pump 1900 and other electronic components.

In the illustrated embodiment, the pump 1900 is a motorized air pump configured to output air through an air outlet into the bottom chamber 1100 upon activation of the switch 1500. In the illustrated embodiment, the switch 1500 is a button. However, in alternate embodiments, the switch 1500 can be any suitable mechanism such as a toggle, a slide, a dial, and the like. The pump 1900 includes a motor, an inlet, an outlet, and an impeller, all operably connected to a power source also contained within the housing. The motor drives the impeller to create a pumping action, moving air through the pump. The air intake of the motorized air pump allows air to be drawn into the pump. The air outlet is connected to the bottom chamber, allowing air to be pumped into the bottom chamber. As air is pumped into the bottom chamber 1100, it displaces the liquid and forces the liquid from the bottom chamber 1100 into the cooling chamber 1200 through the transport tube 1600. In the illustrated embodiment, the rate of pumping is one half ounce of liquid delivered into the cooling chamber 1200 within one half to three seconds. In some embodiments, the switch activates the pump for as long as the switch is depressed or otherwise activated. In other embodiments, the switch comprises a pre-set rate at which the pump is operated such that when the switch is depressed or otherwise activated, the pump will displace a predetermined amount of liquid per activation.

Figure 6:
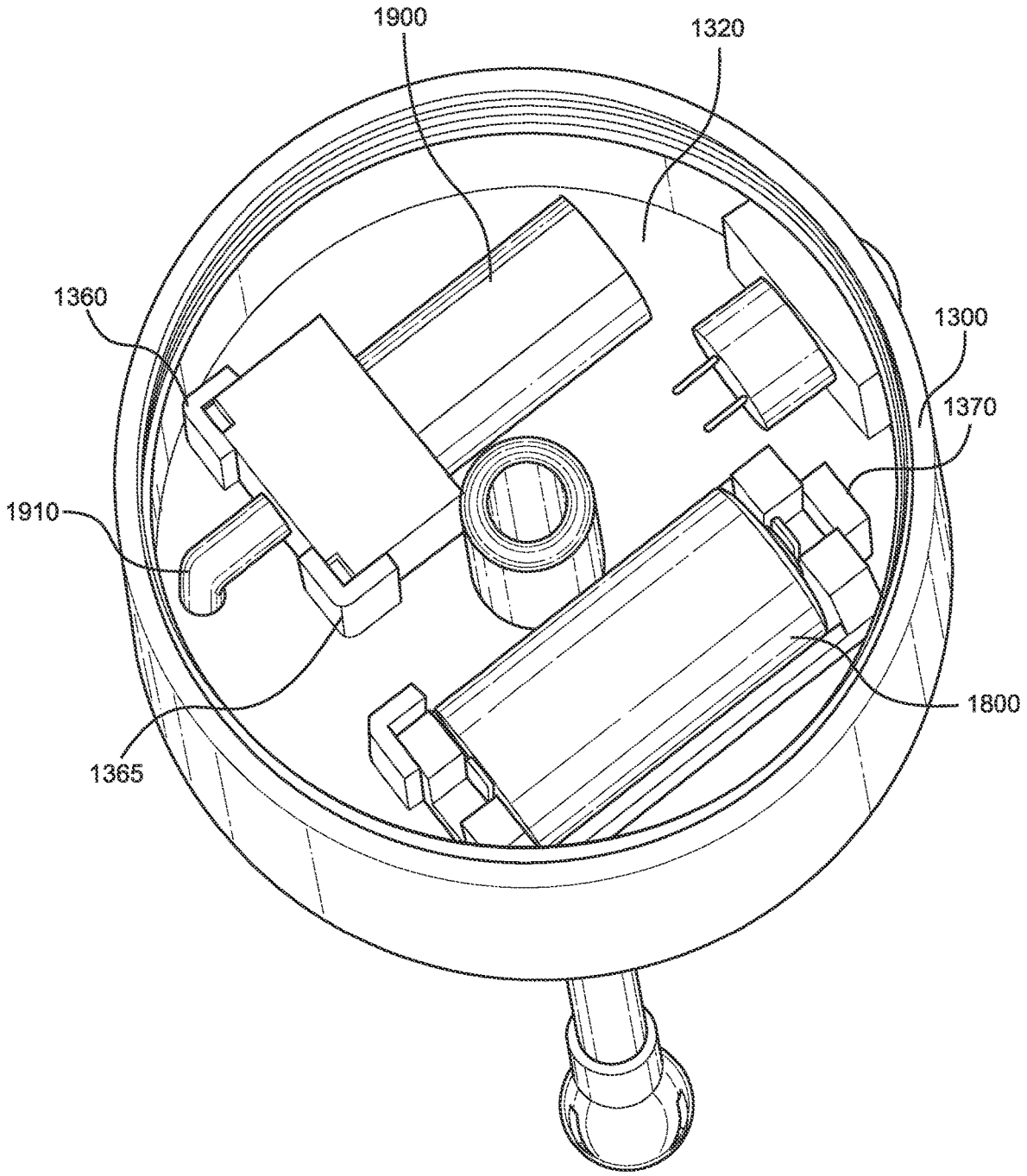
FIG. 6 shows a top planar view of the housing of the dual-chamber beverage container.
Figure 7:
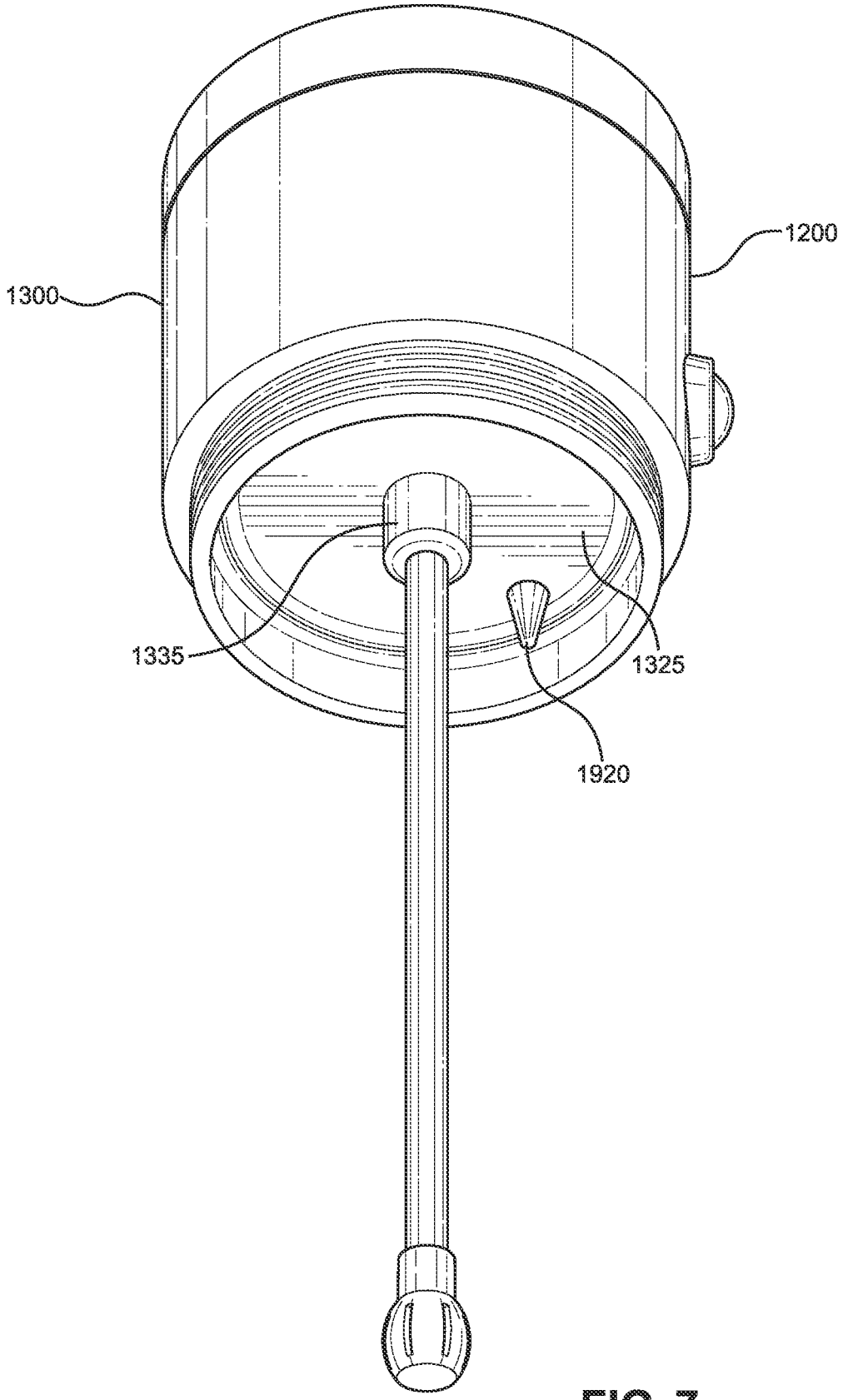
FIG. 7 shows a bottom perspective view of the housing and second chamber of the dual-chamber beverage container.

Referring now to FIGS. 5-7, there is shown an exploded view of the housing of the dual-chamber beverage container, a top planar view of the housing of the dual-chamber beverage container, and a bottom perspective view of the housing and second chamber of the dual-chamber beverage container, respectively. The upper side 1320 of the housing

1300 comprises a power source recess 1340 configured to receive the power source 1800 and a pump recess 1350 configured to receive the pump 1900. In some embodiments, a recess for the power charger board 1810 is also disposed within the upper side 1320 of the housing 1300. The upper side 1320 of the housing is disposed beneath the threads at the upper end thereof. In some embodiments, the power source recess and the pump recess each comprises a brace 1360 disposed at a corner thereof. In some embodiments, the brace 1360 is L-shaped 1365, whereas is other embodiments, the brace 1360 is a block 1370 of material configured to prevent lateral movement.

The air outlet 1940 of the pump 1900 extends through the upper side of the housing to a lower side 1325 of the housing 1300. The lower side 1325 of the housing 1300 serves as a lower surface and is disposed above the threads at the lower end of the housing 1300. The air outlet 190 terminates at a valve 1920 that extends outward from the lower side 1325. In the illustrated embodiment, the valve 1920 is a one-way air valve that prevents air from the bottom chamber to be received therethrough. Only air from the pump 1900 flows through the valve and into the bottom chamber.

In operation, the bottom chamber and the housing are separated, such that a hot liquid can be poured through the open upper end of the bottom chamber. The housing is secured to the bottom chamber creating an air-tight seal therebetween and the cooling chamber with lid is secured to the upper end of the housing, creating an air-tight seal therebetween. The switch on the exterior of the housing is actuated thereby activating the pump. The hot liquid from the bottom chamber is automatically forced upwards through the transport tube and into the cooling chamber. The user can selectively activate the pump to dispense the desired amount of liquid into the cooling chamber due to the clear material used for the cooling chamber and/or lid. Once the desired amount is dispensed within the cooling chamber, the liquid can be sipped as desired.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dual-chamber beverage container, comprising:

a bottom chamber, a cooling chamber, and a housing disposed between the bottom chamber and the cooling chamber, wherein the bottom chamber and the cooling chamber are removably secured to the housing;

a motorized pump operably connected to a power source, wherein the motorized pump is disposed within the housing;

a transport tube extending from the bottom chamber, through a channel within the housing and terminating within the cooling chamber;

a switch disposed on an exterior side of the dual-chamber beverage container and operably connected to the motorized pump such that activation of the switch causes the motorized pump to transfer a predetermined amount of liquid from the bottom chamber into the cooling chamber through the transport tube.

2. The dual-chamber beverage container of claim 1, wherein the bottom chamber, the cooling chamber, and the housing are vertically aligned such that the bottom chamber is disposed entirely beneath the cooling chamber.

3. The dual-chamber beverage container of claim 1, wherein the bottom chamber is insulated.

4. The dual-chamber beverage container of claim 1, wherein a lower end of the cooling chamber is threadedly secured to an upper end of the housing, such that the cooling chamber when removed from the housing provides access to the power source and motorized pump.

5. The dual-chamber beverage container of claim 1, further comprising a temperature indicator operably connected to the cooling chamber and displayed on an exterior of the dual-chamber beverage container, wherein the temperature indicator is configured to detect and display an indication of a temperature of a liquid within the cooling chamber.

6. The dual-chamber beverage container of claim 1, wherein the cooling chamber is composed of a transparent material.

7. The dual-chamber beverage container of claim 1, wherein liquid is prevented from entering the housing when the bottom chamber and the cooling chamber are secured thereto.

8. The dual-chamber beverage container of claim 1, further comprising an air outlet extending from the pump, through an upper side of the housing to a lower side of the housing, wherein the air outlet terminates at a valve that extends outward from the lower side housing.

9. The dual-chamber beverage container of claim 1, wherein the cooling chamber comprises:

a reservoir and an aperture disposed within a first protrusion extending from a bottom of the reservoir for receiving the transport tube;

wherein the first protrusion comprises a threaded underside configured to threadedly engage a second protrusion extending from an upper side of the housing.

10. The dual-chamber beverage container of claim 9, further comprising a gasket disposed on an upper rim of the second protrusion.

11. The dual-chamber beverage container of claim 9, wherein the first protrusion and the second protrusion are centrally disposed along a vertical axis extending from a center point of the dual-chamber beverage container.

12. The dual-chamber beverage container of claim 1, further comprising a pump recess and a power source recess disposed on an upper side of the housing.

13. The dual-chamber beverage container of claim 12, further comprising a pair of L-shaped braces disposed at adjacent corners of the pump recess.

14. The dual-chamber beverage container of claim 12, further comprising a pair of L-shaped braces disposed at adjacent corners of the power source recess.

15. The dual-chamber beverage container of claim 1, wherein the housing comprises a pair of protrusions extending from an upper side and a lower side thereof, wherein the pair of protrusions extend the channel beyond the upper side and the lower side of the housing.

16. The dual-chamber beverage container of claim 1, wherein a portion of the transport tube extends into a reservoir of the cooling chamber.

17. The dual-chamber beverage container of claim 1, wherein the predetermined amount of liquid transferred into the cooling chamber per activation of the switch is between a rate of 0.5-1.0 ounce per 0.5-3.0 seconds.

18. The dual-chamber beverage container of claim 1, further comprising a transparent lid configured to removably cover the cooling chamber.

19. The dual-chamber beverage container of claim 1, wherein the transport tube is separable from the housing by manually pulling the transport tube therefrom.

20. The dual-chamber beverage container of claim 1, further comprising a port disposed on the housing and operably connected to the power source for allowing external electronic devices to be charged by the power source.

* * * * *